United States Patent [19]

Grehl

[11] Patent Number: 4,754,689

[45] Date of Patent: Jul. 5, 1988

[54] COMBINATION PLASTIC SPRING GUIDE AND BUFFER FOR AUTOMATIC PISTOL

[75] Inventor: William H. Grehl, Wallingford, Conn.

[73] Assignee: Colt Industries Inc., New York, N.Y.

[21] Appl. No.: 31,641

[22] Filed: Mar. 30, 1987

[51] Int. Cl.[4] ..... F41D 11/12

[52] U.S. Cl. ..... 89/196; 89/198

[58] Field of Search ..... 89/195, 196, 197, 198, 89/163

[56] References Cited

U.S. PATENT DOCUMENTS

| | | | |
|---|---|---|---|
| 2,522,192 | 9/1950 | Porter | 89/198 |
| 3,435,727 | 4/1969 | Pachmayr et al. | 89/196 |
| 3,756,121 | 9/1973 | Roy | 89/198 |
| 4,222,308 | 9/1980 | Arnett | 89/163 |
| 4,463,655 | 8/1984 | Krieger | 89/196 |
| 4,479,320 | 10/1984 | Fix | 42/70.11 |
| 4,522,107 | 6/1985 | Woodcock et al. | 89/196 |

*Primary Examiner*—Stephen C. Bentley
*Assistant Examiner*—Stephen M. Johnson
*Attorney, Agent, or Firm*—Richard A. Dornon; Howard S. Reiter

[57] ABSTRACT

A pistol (10) has a combination action spring guide and slide buffer (58). The spring guide and buffer has a plastic head segment (64) and an integral plastic guide rod (66). The head segment has two enlarged diameter portions (68, 70) separated by a recess into which a metal plate (76) is positioned. The metal plate prevents deformation and deterioration of the head segment which acts as a cushion for the pistol slide (20).

3 Claims, 2 Drawing Sheets

COMBINATION PLASTIC SPRING GUIDE AND BUFFER FOR AUTOMATIC PISTOL

TECHNICAL FIELD

This invention relates to pistols, and more particularly to buffers for automatic pistols.

BACKGROUND ART

Automatic pistols have a recoil which causes the slide to slam against the pistol frame at the termination of the recoil stroke. Such a pounding of a metal abutment decreases the accuracy of the pistol and may due to the increased shock caused by metal to metal pounding, result in cracking of the frame or rendering certain components inoperative over an extended period of service.

In order to cushion and buffer slide impacts, various arrangements have been devised. For example, U.S. Pat. No. 3,756,121 shows a spring guide made of a tough, resilient, form sustaining plastic for absorbing slide impact energy. U.S. Pat. No. 4,522,107 shows a slide shock absorbing assembly having two metal plates with a resilient plastic sheet of energy dissipating material disposed there between. U.S. Pat. No. 3,901,124 shows a recoil absorber assembly adapted to damp the recoil energy through the use of an air cushion, a spring cushion and a rubber cushion.

While the slide shock absorbing arrangements of the prior art exhibit satisfactory performance when exposed to reasonable recoil impacts, the severe load encountered in powerful pistols, such as a 10 mm pistol, can cause permanent deformation of the plastic material after repeated use. In addition, the prior art arrangements which have attempted to prevent deformation of the plastic material have involved a number of parts which can add to manufacturing and assembly costs. Moreover, the use of piston assemblies to achieve an air cushion obviously mandates a somewhat expensive and complex installation.

DISCLOSURE OF THE INVENTION

The invention provides a relatively simple and inexpensive plastic spring guide which resists deterioration and deformation even when utilized in a powerful pistol over an extended period of time. Because of its unique design, a spring guide of the invention is capable of adequately cushioning the impact of a rearwardly moving pistol slide.

A spring guide of the invention incorporates a guide rod segment and a head segment of resilient plastic which functions as both a spring seat and an abutment for the slide. The head segment in a spring guide of the invention has at least two enlarged diameter portions and a metal plate located there between. The metal plate facilitates an even distribution of the forces applied to the head by the slide and frame over the forward enlarged diameter portion such that a breaking down of the resilient plastic is prevented. In addition, the slide engages the plastic material at the front face of the forward enlarged diameter portion at the termination of recoil, thereby providing effective cushioning.

Accordingly, it is a primary object of the invention to provide a combination plastic spring guide and buffer for an automatic pistol which is resistant to deformation and deterioration.

Another object is to provide a spring guide for an automatic pistol having a head segment of plastic with two enlarged diameter portions and a metal plate interposed therebetween.

These and other objects and advantages of the invention will become more readily apparent from the following detailed description, when taken in conjunction with the accompanying drawings, in which:

BEST MODE OF CARRYING OUT OF THE INVENTION

Figure 1:
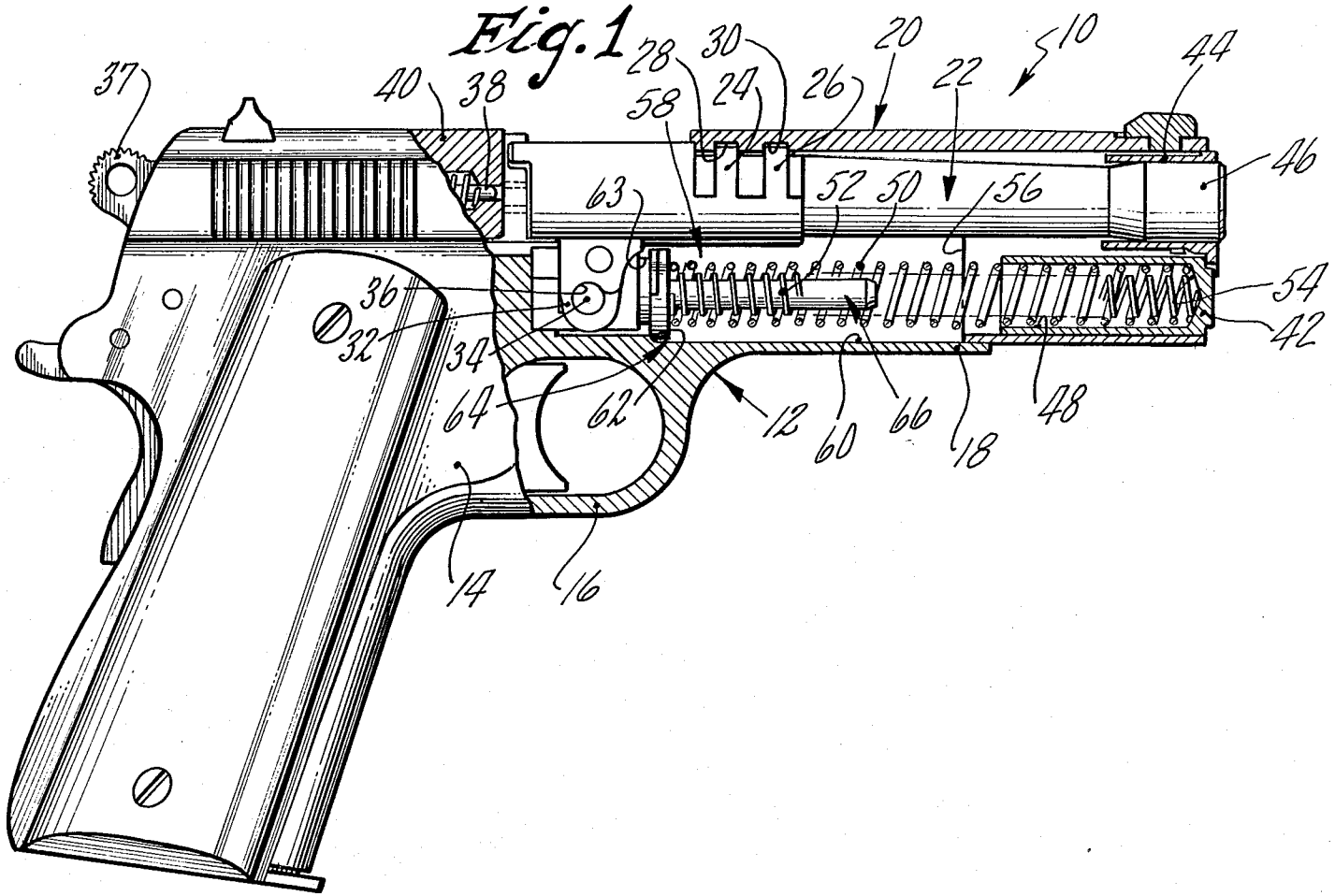
FIG. 1 is a side view, partly broken away and partly in section, of an automatic pistol incorporating a plastic spring guide according to the invention.

Referring to the drawings, a firearm in the form of a semi-automatic pistol 10, of conventional design, is illustrated in FIG. 1. Pistol 10 has a frame 12 which incorporates a handle portion 14, a trigger guard 16, and an elongated slide support or receiver 18. An operating breech slide 20 is mounted upon the slide support 18 for reciprocal sliding movement between a rear recoil position and a forward battery position. An elongated barrel 22, which is enveloped by the slide 20, includes three locking surfaces two of which are formed by a pair of locking lugs 24 and 26 formed thereupon which register with and fit into respective grooves 28 and 30 formed in the slide when the slide occupies its forwardmost or battery position. The usual link 32, which is pivotally connected to the barrel 22, is a secured to the frame 12 by means of a pin 34 which extends through a bore 36 therein.

Falling of a hammer 36 occasions a displacement of a firing pin 38 which is mounted in the breech bolt 40. Upon striking of a chambered cartridge (not shown) by the firing pin 38, the firearm is fired, whereupon recoil commences as beget by the urging of the chambered cartridge casing on the face of the breech bolt 40. Rearward recoil movement of the slide 20 causes the barrel 22 to move rearwardly by virtue of the interconnection between the barrel 22 and the slide 20 as furnished by the locking lugs 24 and 26 in the respective grooves 28 and 30. When the barrel 22 and slide 20 have traveled together for a short distance, the pivotal movement of the link 32 causes the rear part of the barrel 22 to move downwardly, thereby resulting in disengagement between the locking lugs and the grooves, which action prevents further rearward movement of the barrel 22. The slide 20, however, continues its rearward movement, which would be abruptly terminated by engagement with the frame were it not for cushioning in accordance with the invention. As shown in FIG. 1, the breech slide 20 incorporates the usual plug or cap 42 mounted at the muzzle end of the pistol 10 in juxtaposed relationship to a barrel bushing 44 in which the muzzle end 46 of the barrel 22 is slideably mounted. Plug 42 is of a conventional design and is removable to facilitate disassembly of the pistol 10. Plug 42 is formed with a cavity 48 which receives two concentric counterwound springs 50 and 52 that seat against the base 54 of the cavity 48. The slide 20 embodies a U shape edge surface 56 and it is this surface that would normally engage an abutment on the frame 12 to terminate the recoil stroke of the slide 20. A combination spring guide and buffer, generally indicated at 58, is mounted in a U shaped cavity 60 in the frame 12. Cavity 60 is formed with the typical upwardly facing opening and a transverse shoulder or abutment 62 adjacent the rear sidewalls of the cavity 60. Cavity 60 communicates with a smaller U shaped cavity 63 to the left of abutment 62. The spring guide 58 is generally constituted by a head segment, generally indicated at 64, against which the springs 50 and 52 are seated and a guide rod segment, generally indicated at 66 about which the springs 50 and 52 are coiled. The spring guide 58 is preferably made virtually entirely of a plastic resilient material which has energy absorbing capabilities. An acetal resin thermo plastic polymer made by the polymerization of formaldehyde is a suitable material. Such a material is manufactured by E.I. dupont de Numours & Co. and is sold under the trademark Delrin. Obviously, other plastic materials would also be suitable for the spring guide.

Figure 3:
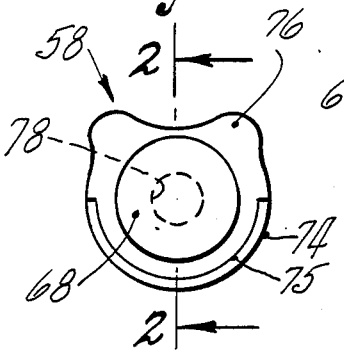
FIG. 3 is a rear elevational view of the spring guide of FIGS. 1 and 2, as it would appear looking along the line 3—3 of FIG. 2.
Figure 2:
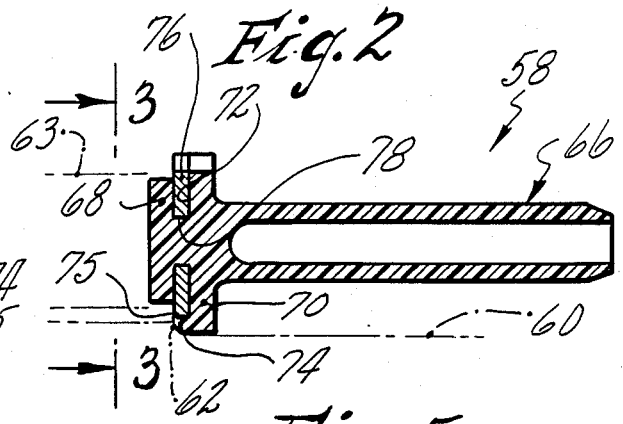
FIG. 2 is a side elevational, sectional view of the spring guide shown in FIG. 1.
Figure 4:
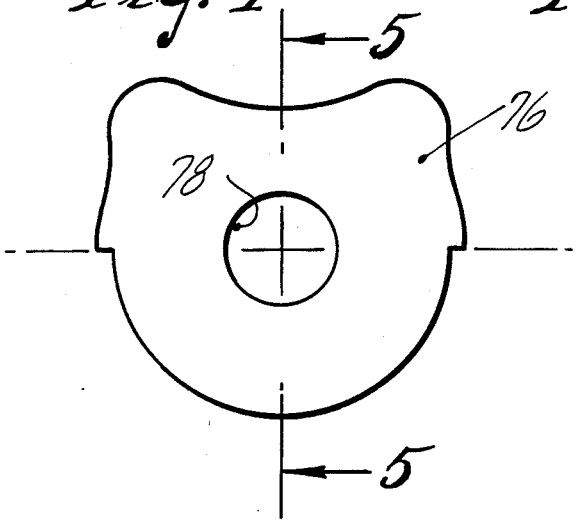
FIG. 4 is a rear elevational view of the metal plate, per se, in the spring guide of FIGS. 1–3, inclusive.
Figure 5:
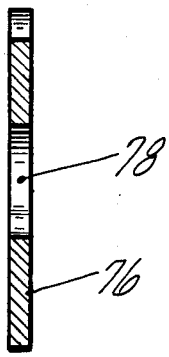
FIG. 5 is a sectional view of the metal plate, taken along the line 5—5 of FIG. 4.

With particular reference to FIGS. 2 and 3, wherein the spring guide 58 is shown per se, it will be seen that the head segment 64 of the spring guide 58 is constituted by rear and front enlarged diameter portions 68 and 70. The upper surface of the front enlarged diameter portion 70 has a central concave area adjoining convex side areas. A circumferential recess 72 is defined between the enlarged diameter portions 68 and 70 in such a manner that a rearwardly extending semicircular lip 74 in defined with a rear surface 75 perpendicular to the axis of the spring guide. A metal plate 76 (FIGS. 4 and 5) having a shape similar to that of the front enlarged diameter portion 70, but with a centrally located opening 78 therein, is received within the recess 72 such that the reduced diameter section of head segment 64 extends through the opening 78. The rear surface of the plate 76 lies flush with that of the lip 74. As should be evident from FIGS. 2 and 3, the rear enlarged diameter portion 68 of the head segment 64 is cylindrical and is smaller then the enlarged diameter portion 70, whereby the outer peripheral rear surface of the plate 76 is exposed. From FIG. 2, it will be seen that the guide rod segment 66 is hollow so as to facilitate the molding process. The lip is formed and molded with a radius to match a like radius in the abutting receiver area, whereby the metal plate will not engage the radius and cause stress concentrations in the frame.

The phantom lines in FIG. 2 best illustrate the disposition of the spring guide 58 to the frame 12. The cylindrical enlarged head portion 68 serves merely as a locator and is received within the cavity 63. It is the rear peripheral surface of the plate 76 and the rear lip 75 which engage the shoulder 62. The springs 50 and 52 are, of course, seated against the front face of the enlarged diameter portion 70, thereby urging the rear peripheral surface of the plate 76 and rear surface 75 of the lip 74 firmly against the shoulder.

As recoil terminates, the U-shaped surface 56 of the slide 20 slams into the front face of the enlarged diameter portion 70. Such an impact will tend to compress the enlarged diameter portion 70. However, the plate 76 will cause an even distribution of the pressure acting upon the rear face of enlarged diameter portion 70 and thereby prevent its deformation. Although the impact of the slide 20 on the front face will not be evenly distributed thereover, it has been found that no unacceptable deformation of deteriation will result therefrom.

Figure 6:
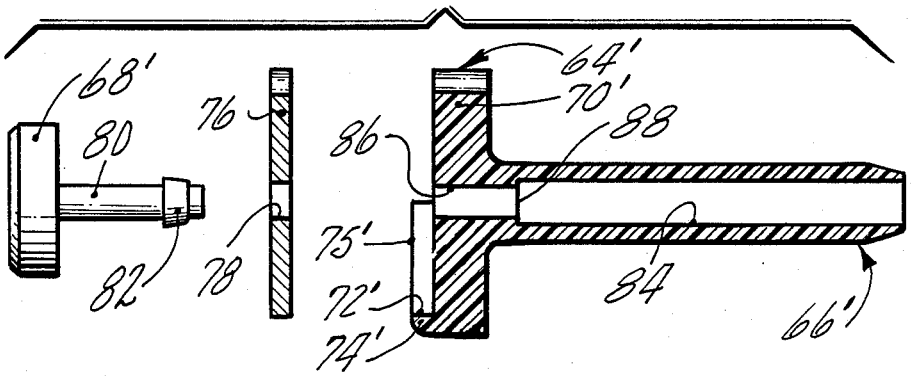
FIG. 6 is an exploded side elevational view, partly in section, of another embodiment of a spring guide of the invention.

The spring guide shown in FIGS. 1—3 is integrally molded with the metal plate 76 therein. Alternatively, the spring guide can be readily assembled from discrete components as is depicted in the exploded view of FIG. 6. In FIG. 6 parts identical to those previously described have like numerals and similar parts carry like primed numerals. As shown in FIG. 6, the cylindrical enlarged diameter portion 68' carries a projecting centrally disposed shaft 80 having a tapered land 82 (which may be tapered or cylindrical) thereupon for extending through the opening 78 in the metal plate. The land 82 could also take the form of a tab. The guide rod segment has a cylindrical opening 84 therein which communicates with a smaller cylindrical opening 86 in the enlarged diameter portion 70' to thereby define an engagment surface 88 which the rear of the land 82 abuts when snap fitted therein with the metal plate positioned in the recess. This form of construction would typically be less expensive than that previously described and would involve only three parts.

Obviously, many modifications and variations are possible in light of the above teachings without departing from the scope or spirit of the invention as herein defined in the appended claims.

I claim:

1. In a semi-automatic pistol of the type having a frame with a U-shaped cavity with a transversely extending shoulder and a ssmall U-shaped cavity to the rear of the shoulder; a barrel mounted on the frame; a slide mounted on the frame in surrounding relationship to the barrel for reciprocating movement between rearward recoil and forward battery positions; and an action spring seated in the slide, an improved spring guide and buffer comprising:

an elongated plastic guide rod segment having an axis;

a plastic head segment having rear and front enlarged diameter portions joined by a reduced diameter section and a circumferential recess defined between the rear and front enlarged diameter portions such that a rearwardly extending, semicircular lip with a rear surface perpendicular to the axis of the guide rod segment is defined on the front enlarged diameter portion; the front enlarged diameter portion having an upper surface with a central concave area adjoined by two convex side areas; the rear enlarged diameter portion being smaller than the front enlarged diameter portion and having a cylindrical shape;

a metal plate having a front surface, a rear surface, an outer peripheral edge with a shape generally similar to that of the front enlarged diameter portion and a centrally located opening therein extending between the front and rear surfaces thereof, the metal plate being received in the recess such that the reduced diameter section of the head segment is received within the centrally located opening and the rear surface of the metal plate is flush with the rear surface of the lip; and the rear enlarged diameter portion being a locator and mounted within the smaller U-shaped cavity, the front enlarged diameter portion and the guide rod segment being mounted in the first mentioned U-shaped cavity with an outer peripheral portion of the rear surface of the metal plate in engagement with the shoulder and the action spring seated against a front surface of the front enlarged diameter portion.

2. The improvement of claim 1, wherein the head segment, the guide rod segment and the metal plate are integrally molded into a one piece construction.

3. The improvement of claim 1, wherein the reduced diameter section of the head segment comprises:

a forwardly extending plastic shaft, having a land thereupon, integral with the rear enlarged diameter portion, the head segment and the guide rod segment having different sized, axially aligned, communicating openings therein which define an engagement surface therebetween for the land to thereby provide a snap fit.

* * * * *